United States Patent [19]

Yamada

[11] Patent Number: 4,902,936

[45] Date of Patent: Feb. 20, 1990

[54] LIGHT ADJUSTING APPARATUS

[75] Inventor: Yoshikado Yamada, Kashihara, Japan

[73] Assignee: Sharp Kabushiki Kaisha, Osaka, Japan

[21] Appl. No.: 358,532

[22] Filed: May 30, 1989

Related U.S. Application Data

[63] Continuation of Ser. No. 123,288, Nov. 20, 1987, abandoned.

[30] Foreign Application Priority Data

Nov. 20, 1986 [JP] Japan ..... 61-278972

[51] Int. Cl.[4] ..... H05B 41/36

[52] U.S. Cl. ..... 315/158; 315/154; 315/199; 315/209 R; 315/DIG. 5; 355/68; 355/69

[58] Field of Search ..... 315/154, 155, 156, 157, 315/158, 194, 199, 208, 209 R, DIG. 4, DIG. 7; 355/68, 69; 307/632

[56] References Cited

U.S. PATENT DOCUMENTS

| | | | |
|---|---|---|---|
| 3,996,494 | 12/1976 | Suga | 315/151 |
| 4,331,914 | 5/1982 | Huber | 315/199 |
| 4,373,146 | 2/1983 | Bonazoli et al. | 315/209 R |
| 4,463,284 | 7/1984 | Tamura | 315/158 |
| 4,624,547 | 11/1986 | Endo | 355/68 |

*Primary Examiner*—Donald J. Yusko
*Assistant Examiner*—Brian Palladino
*Attorney, Agent, or Firm*—Birch, Stewart, Kolasch & Birch

[57] ABSTRACT

A light adjusting apparatus comprising a lamp connected to a commercial a.c. power supply via a triac, and a switching control circuit operable by a direct current obtained by directly rectifying the current of the power supply for controlling the conduction timing of the triac based on the zero-cross timing of the power supply. The conduction timing of the triac is controlled by a signal obtained by producing a pulse-width modulated light adjusting signal from a signal generating circuit by a light-emitting element, causing a photodetector in the control circuit to receive the adjusting signal and subjecting the resulting output of the control circuit to pulse-width demodulation.

5 Claims, 5 Drawing Sheets

LIGHT ADJUSTING APPARATUS

This application is a continuation, of application Ser. No. 123,288 filed on Nov. 20, 1987, now abandoned.

BACKGROUND OF THE INVENTION

1. Field of the Invention

The present invention relates to an apparatus for adjusting the light of a lamp, such as one serving as a light source for illuminating documents inserted in a copying machine.

2. Description of the Prior Art

Halogen lamps are chiefly used for copying machines as light sources for illuminating documents. The light of the halogen lamp is adjusted by applying a commercial a.c. power supply as controlled in phase. FIG. 6 shows an example of circuit conventionally used as such a light adjusting apparatus. As shown in the drawing, a lamp 1 is connected to a commercial a.c. power supply AC through a triac T serving as a switching element. The triac T is controlled in phase in accordance with an output signal from a switching control circuit 3 via a pulse transformer PT. The current from the power supply AC is directly rectified by a diode bridge DB to a direct current, which operates the switching control circuit 3. The circuit diagram further shows a coil L serving as a rush current restricting reactor, a gate current rectifying diode D1 for the triac T, and a diode D2 for absorbing a spike due to the pulse transformer PT.

Thus, the switching control circuit 3 is driven by the direct current obtained by directly rectifying the current of the commercial a.c. power supply without using any isolating transformer to render the overall circuit less costly.

FIG. 7 shows the circuit of another conventional light adjusting apparatus. This circuit differs from the circuit of FIG. 6 in that the pulse signal to be produced by a switching circuit 3 is controlled in phase by a light adjusting signal generating circuit 2. When the control circuit 3 is thus given a light adjusting signal from outside, the power supply for the circuit 3 must be isolated from the commercial a.c. power supply. For this purpose, a power supply equipped with an isolating transformer 4 is used for the control circuit 3 as illustrated.

However, these conventional light adjusting apparatus have problems. When the current obtained by directly rectifying the commercial a.c. power supply is used for the switching control circuit as shown in FIG. 6, the circuit of the apparatus can be simplified in construction and is available at a reduced cost, but the light must be adjusted as by a variable resistor VR, while it is impossible to use an external light adjusting signal for phase control. Further when the switching control circuit is driven by the insulated power supply as seen in FIG. 7, it is possible to give a light adjusting signal from outside directly to the control circuit, whereas there arises a need to use the insulating transformer therefor, rendering the apparatus costly and large-sized.

SUMMARY OF THE INVENTION

The present invention provides a light adjusting apparatus comprising a lamp connected to a commercial a.c. power supply through a switching element, a rectifier for directly rectifying the current of the power supply to give an output, a switching control circuit operable by the d.c. output of the rectifier for controlling the conduction timing of the switching element based on the zero-cross timing of the a.c. power supply, and a light adjusting signal generating circuit for producing a pulse-width modulated light adjusting signal by a light-emitting element, the switching control circuit comprising a photodetector for receiving the light adjusting signal from the light-emitting element, a demodulation circuit for subjecting the output signal from the photodetector to pulse-width demodulation, and a conduction timing control circuit for controlling the conduction timing of the switching element by the output signal of the demodulation circuit.

With the light adjusting apparatus of the invention having the above construction, the photodetector included in the switching control circuit receives a light adjusting signal. The output signal from the photodetector is subjected by the demodulation circuit to pulse-width demodulation. According to the output signal of the demodulation circuit, the conduction timing control circuit controls the conduction timing of the switching element. The light adjusting signal, which is pulse-width modulated, is fed to the photodetector by the light emitting element of the light adjusting signal generating circuit. The light adjusting signal given to the photodetector of the switching control circuit by the signal generating circuit is in the form of a rectangular wave signal of a pulse width corresponding to a predetermined amount of light, which controls the conduction timing of the switching element for switching the current through the lamp. The light-emitting element and the photodetector are optically coupled together and electrically isolated, so that irrespective of whether a current obtained by directly rectifying the commercial a.c. power is used for energizing the light adjusting signal generating circuit, such current obtained by direct rectification is usable for energizing the switching control circuit.

Briefly stated, the present invention makes it possible to drive the switching control circuit by a current obtained by directly rectifying the commercial a.c. power supply and to give a light adjusting signal to the switching control circuit.

BRIEF DESCRIPTION OF THE DRAWINGS

FIG. 4 is a diagram showing the relation between the light adjusting signal and the phase angle at which a switching element is on;

DESCRIPTION OF THE PREFERRED EMBODIMENTS

The lamp to be used in the light adjusting apparatus of the invention is preferable a halogen lamp useful as a document illuminating light source for electrophotographic copying machines, facsimile systems or the like.

While a diode bridge is usually used as the rectifier, a suitable rectifier is selected for use depending on the apparatus for which the present apparatus is to be used.

The switching control circuit of the invention is driven by the d.c. output of the rectifier for controlling the conduction timing (on-time) of the switching element based on the zero-cross timing of a commercial a.c. power supply. This control circuit comprises a photodetector, a demodulation circuit and a conduction timing (on-time) control circuit. Preferably, the on-time control circuit is so adapted as to give an on-time phase angle of 180° to the switching element when the output of the demodulation circuit is zero. When the circuit is so adapted, substantially no current passes through the lamp to deenergize the lamp in the case where the light adjusting signal generating circuit gives a signal of 0% duty cycle or produces no signal. This eliminates the need for a special on-off switching signal for the lamp.

Preferably, the light adjusting signal generating circuit comprises a sensor for detecting the amount of light reflected from the object to be illuminated by the lamp, a microcomputer for providing light adjusting data in accordance with the amount of reflected light, and a modulation circuit for subjecting the output from the microcomputer to pulse-width modulation and producing the resulting signal as a light adjusting signal.

It is desirable to use a triac as the switching element.

The light-emitting element and the photodetector to be used are usually in the form of a photocoupler composed of a light-emitting diode and a phototransistor.

The present invention will be described below with reference to the illustrated embodiment.

Figure 2:
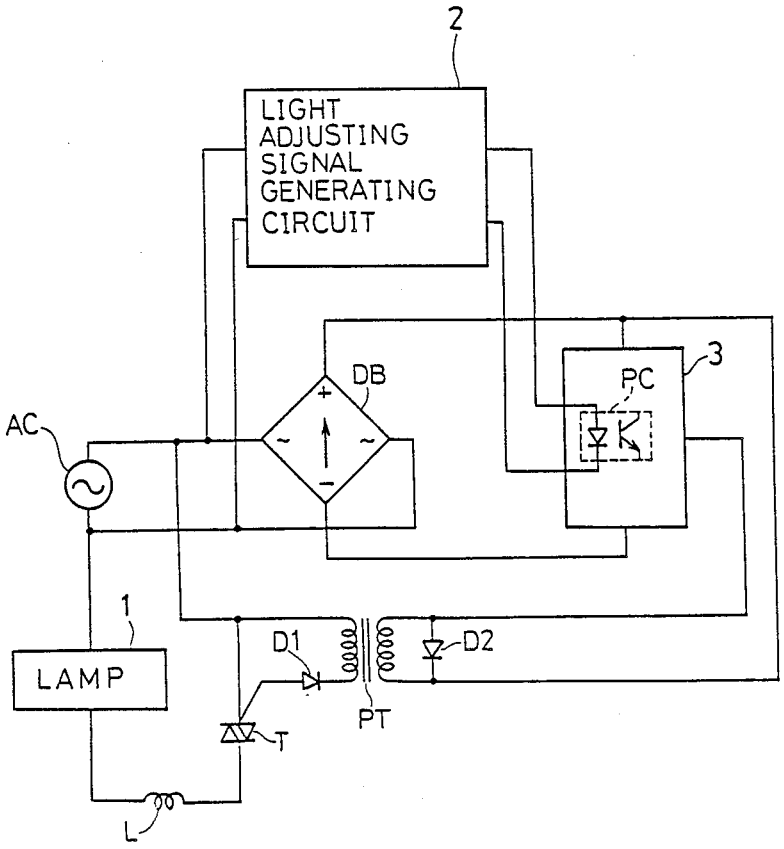
FIG. 2 is a diagram schematically showing the circuit.
Figure 7:
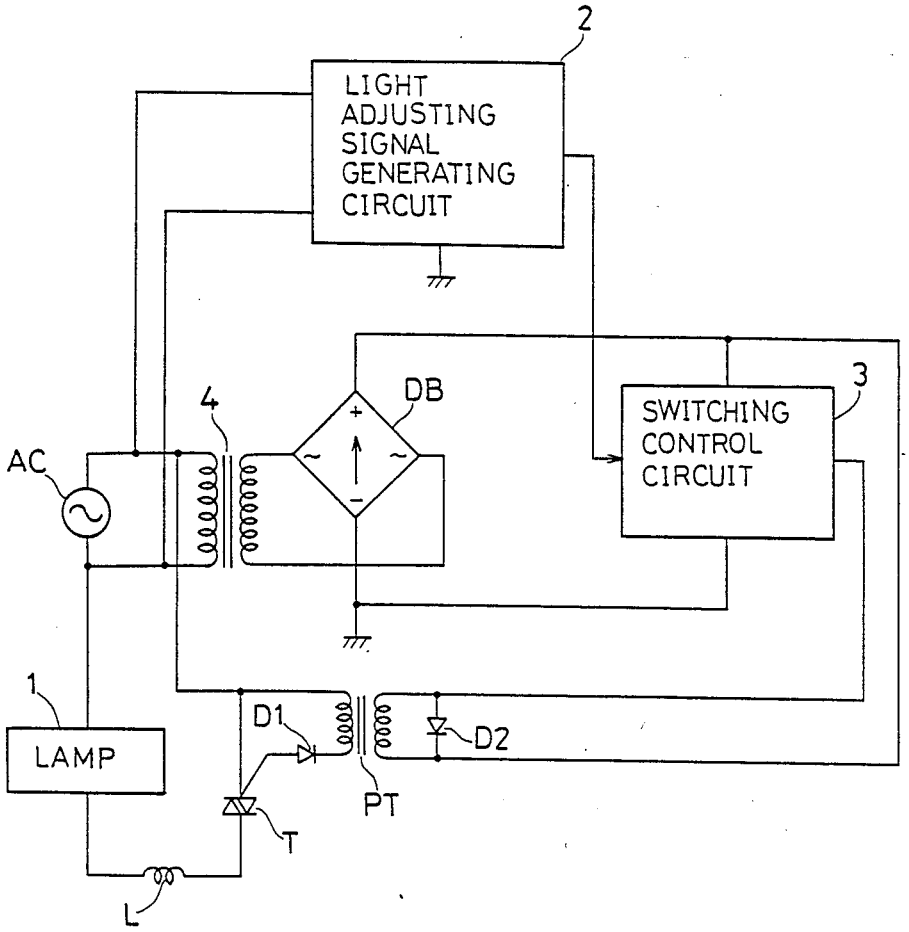
FIG. 7 (prior art)

FIG. 2 is a schematic circuit diagram showing a light adjusting apparatus embodying the invention. As will be apparent from comparison with the conventional circuit of FIG. 7, a switching control circuit 3 is driven by a current obtained by directly rectifying the current of a commercial a.c. power supply AC by a diode bridge DB. The control circuit 3 includes a photocoupler PC which is given a light adjusting signal by a light adjusting signal generating circuit 2.

Figure 1:
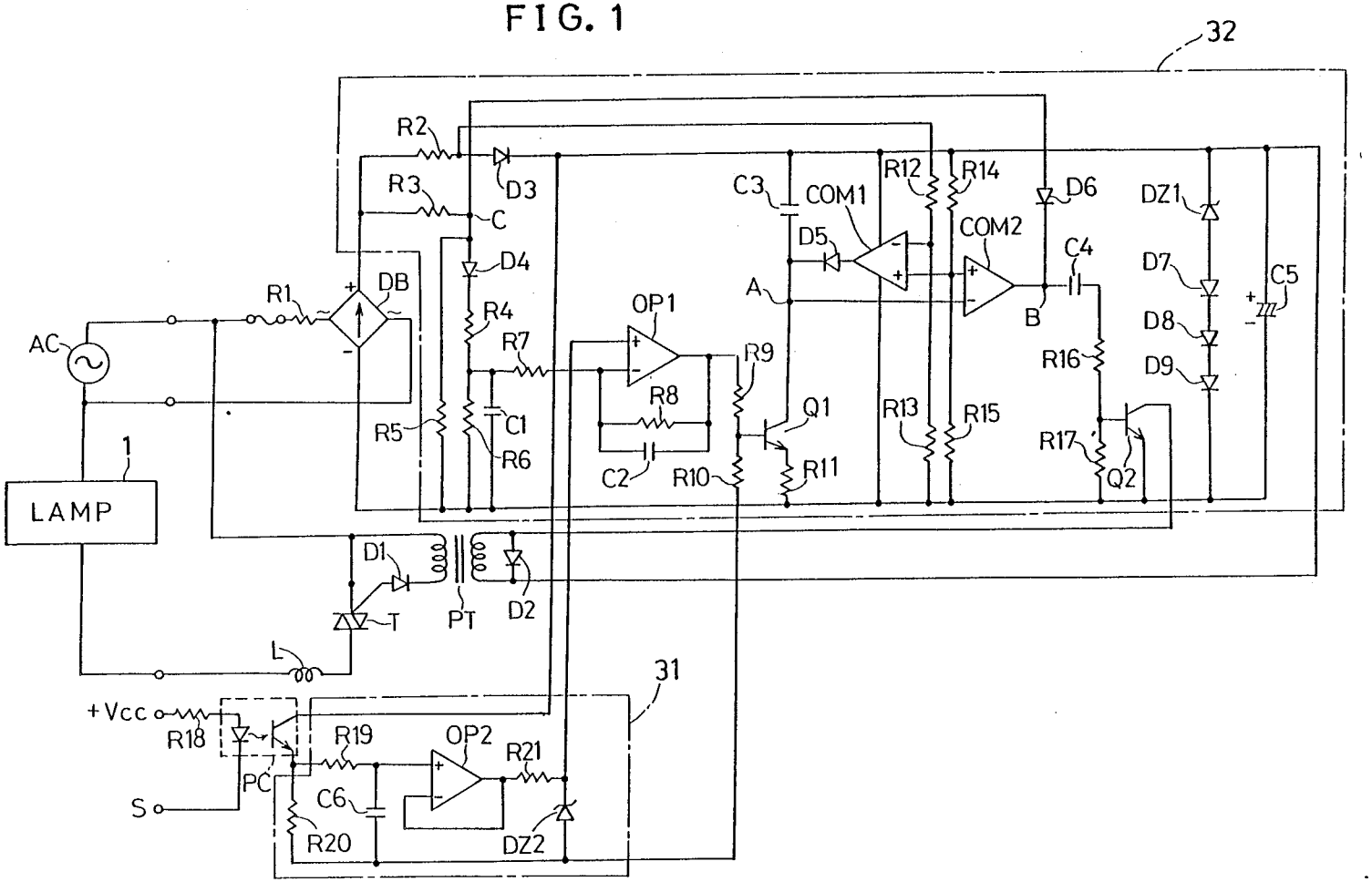
FIG. 1 is a circuit diagram showing in detail a light adjusting apparatus embodying the invention.

FIG. 1 shows the circuit of the apparatus in detail. The diagram shows the photocoupler PC, a demodulation circuit 31 for subjecting the output signal of the photocoupler PC to pulse-width demodulation, and a timing control circuit 32 for controlling the on-time of a triac T serving as a switching element by the output signal of the demodulation circuit 31. The current through the demodulation circuit 31 and through the timing control circuit 32 is restricted by a resistor R1. The current through the light emitting diode of the photocoupler PC is restricted by a resistor R18. The circuit operates as follows.

First, the input terminal S of the photocoupler PC receives a rectangular wave signal having a duty cycle in accordance with the amount of light to be adjusted. The output of the phototransistor of the photocoupler PC, i.e. the voltage at the junction of the emitter of the phototransistor and a resistor 20, is integrated by a low-pass filter comprising a resistor R19 and a capacitor C6 and then applied to a voltage follower circuit comprising an operational amplifier OP2. Accordingly, the amplifier OP2 produces a d.c. voltage signal in accordance with the duty cycle of the light adjusting signal.

Figure 3:
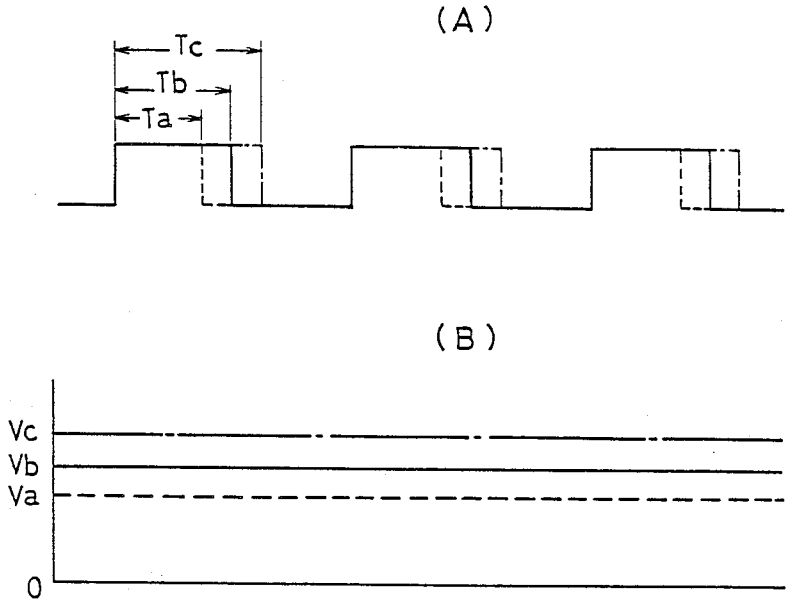
FIGS. 3 (A) and 3 (B) are diagrams showing waveforms at specific points of a demodulation circuit.

FIGS. 3 (A) and 3 (B) show the light adjusting signal fed to the terminal S shown in FIG. 1 and the output signal of the operational amplifier OP2, respectively. It is seen in FIG. 3 (A) that the high-level width of the rectangular wave signal varies from Ta to Tb and to Tc. The output voltage of the amplifier OP2 then varies from va to vb and to Vc as shown in FIG. 3 (B). The duty cycle is approximately in proportion to the output voltage of the amplifier OP2.

Thus, the demodulation circuit 31 effects pulse-width demodulation, giving a voltage signal. FIG. 1 further shows a resistor R21 and a Zener diode DZ2 which provide a limiter circuit for setting an upper limit for the output voltage.

With reference to FIG. 1, the on timing control circuit 32 has the following construction and operates as follows. A capacitor C5, Zener diode DZ1 and diodes D7, D8 and D9 are provided for stabilizing the power supply voltage of the circuit. An operational amplifier OP1 has applied to its non-reversible input terminal the output voltage of the demodulation circuit 31 and to its reversible input terminal a d.c. voltage proportional to the voltage to be applied to the lamp 1. More specifically, the positive output of the diode bridge DB has a voltage waveform which is formed when voltage is applied to the lamp 1 at all times. As will be described later, the voltage at point B is at a high level when voltage is applied to the lamp, so that through a resistor R3 and a diode D6, a signal is provided at point C which is similar to the voltage waveform to be applied to the lamp 1. From the signal at point C, a rectification-integration circuit comprising a diode D4, resistor R6, capacitor C1 and resistor R7 produces a d.c. voltage which varies in proportion to the voltage to be applied to the lamp 1. This voltage is applied to the reversible terminal of the operational amplifier OP1. The amplifier OP1 cuts off a high-frequency component by the action of a capacitor C2 and amplifies the input at a ratio which is determined by the resistors R7 and R8. The output voltage of the amplifier OP1 is divided by resistors R9 and R10 and fed to the base of a transistor Q1. On the other hand, a reference voltage afforded by resistors F14 and R15 is applied to the non-reversible input terminal of a comparator COM1, while a full-wave rectified waveform given by resistors R2, R12 and R13 is applied to the reversible input terminal thereof. Consequently, zero-cross pulses rising to high level are produced as the output of the comparator COM1. A diode D3 is a reverse flow preventing diode for deriving the full-wave rectified waveform. During the interval of high level of the zero-cross pulses, a capacitor C3 is charged through a diode D5. During the interval of low level of the zero-cross pulses, the capacitor C3 is discharged by the transistor Q1 and a resistor R11. Accordingly, a signal of sawtooth waveform is available at point A. If the voltage of the power supply AC drops, the input voltage at the reversible input terminal of the amplifier OP1 drops, thereby causing the amplifier OP1 to give a higher output voltage. With an increase in the output voltage of the operational amplifier OP1, the duration of discharge of the capacitor C3 becomes shorter, giving an increased inclination to the sawtooth wave. Further when the duty cycle of the light adjusting signal fed to the terminal S increases, the output voltage of the amplifier OP2 rises, raising the output voltage of the amplifier OP1 and consequently giving an increased inclination to the sawtooth wave similarly.

In accordance with the level at point A, a comparator COM2 determines the phase angle for turning on the lamp 1. More specifically, the reference voltage determined by the resistors R14 and R15 is fed to the non-reversible input terminal of the comparator COM2, and the voltage at point A to the reversible input terminal thereof. Consequently, the comparator COM2 produces as its output a rectangular wave signal having a duty cycle which varies with the inclination or ramp of the sawtooth wave. The rectangular wave signal is differentiated by a capacitor C1 and resistors R16 and R17, and a transistor Q2 conducts with the rise of the signal. Upon the conduction of the transistor Q2, a gate current flows through the triac T via a pulse transformer PT, bringing the triac T into conduction. Accordingly, when the duty cycle of the light adjusting signal increases, giving a greater inclination to the sawtooth wave at point A as already stated, the rectangular wave rises earlier at point B to cause the triac T to conduct earlier.

Figure 4:
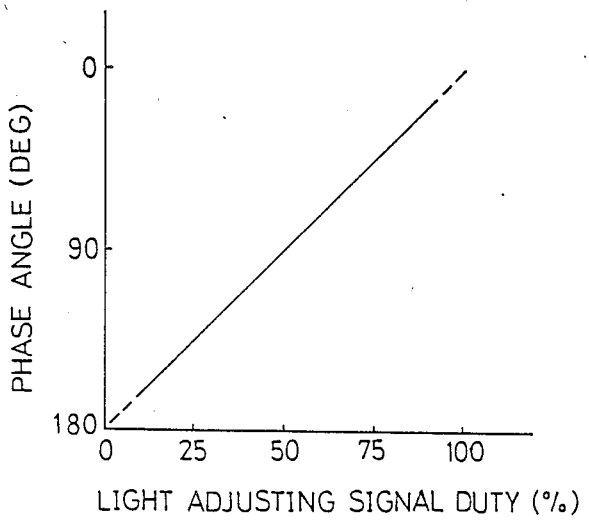

FIG. 4 is a diagram showing the relation between the duty cycle of the light adjusting signal and the phase angle at which the triac is turned on. As seen in the diagram, as the duty cycle of the light adjusting signal increased, the phase angle decreases toward zero to turn on the triac at earlier time. As the duty cycle of the signal decreases, the triac is turned on later. If no light adjusting signal is applied, or when a light adjusting signal with a duty cycle of about 0% is applied, the phase angle at which the triac T is turned on is nearly 180°, with the result that the triac T remains off, with no power supplied to the lamp.

Figure 5:
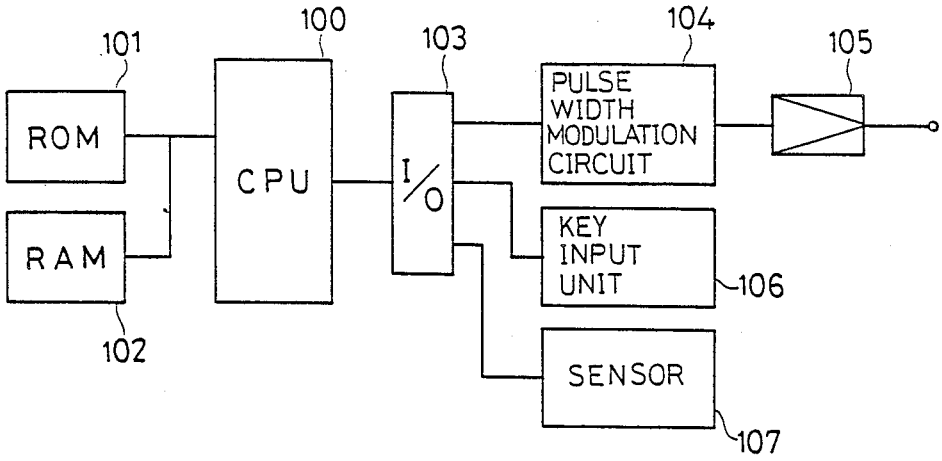
FIG. 5 is a block diagram showing a light adjusting signal generating circuit.
Figure 6:
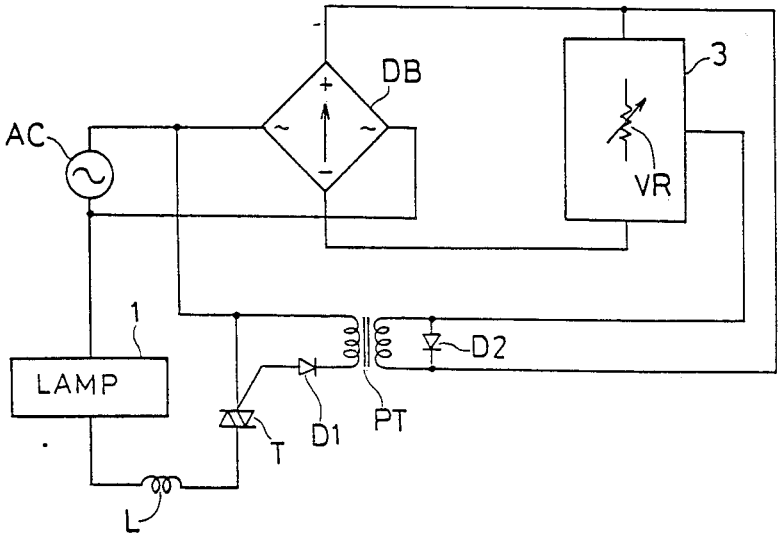
FIG. 6 (prior art)
FIGS. 6 and 7 are diagrams showing the circuits of conventional light adjusting apparatus.

FIG. 5 is a block diagram showing the circuit for generating the light adjusting signal. The overall circuit is controlled by a CPU 100 according to a program stored in a ROM 101. A RAM 102 serves as a working area for executing the control program. Various input and output units are connected to an I/O port 103. In response to an output command from the CPU 100, a PWM (pulse-width modulation) circuit 104 produces a rectangular wave having a duty cycle corresponding to the light adjusting data given through the I/O port 103. The output of the circuit 104 is amplified by an amplification circuit 105 of the open collector output type. The resulting output is fed to the terminal S shown in FIG. 1. A key input unit 106 is used by the operator for giving instructions for conducting a copying operation. Sensor 107 includes various sensors, such as a sensor for detecting the amount of light reflected from the document to be copied. For example in an automatic exposure mode, CPU feeds suitable light adjusting data to the PWM circuit 104 in accordance with the amount of reflected light.

The light adjusting apparatus of the invention is usable for adjusting the amount of light of the document illuminating lamp for use in electrophotographic copying machines, facsimile systems, etc. and also for adjusting the amount of light of illuminating devices in theaters or the like and usual interior illuminating devices.

According to the invention described above, the switching control circuit for a lamp is driven by a current obtained by directly rectifying the current of a commercial a.c. power supply, and the light of the lamp is made controllable by an external light adjusting signal. This eliminates the need to use an isolating transformer, consequently making it possible to provide a compact light adjusting apparatus at a low cost. Further the light adjusting signal used is a rectangular wave signal which is variable in duty cycle, such that when the duty cycle is nearly zero, no power is supplied to the lamp, whereby the lamp is made also on-off controllable at the same time.

What is claimed is:

1. A light adjusting apparatus comprising:

a lamp connected to the output voltage of a commercial a.c. power supply through a switching element, a rectifier for directly rectifying the current of the a.c. power supply to generate a d.c. output, a switching control circuit operable by the d.c. output of the rectifier for controlling the conduction time of the switching element based on the time of the zero-crossing of the a.c. power supply output voltage, and a light adjusting signal generating circuit for producing a pulsewidth modulated light adjusting signal by a light-emitting element, the switching control circuit comprising, a photodetector for receiving the light adjusting signal from the light-emitting element, a demodulation circuit for subjecting the output signal from the photodetector to pulsewidth demodulation, and a conduction timing control circuit for controlling the conduction time of the switching element by the output signal of the demodulation circuit, the conduction timing control circuit further comprising, a voltage adjusting circuit for adjusting the voltage of an output signal from the demodulation circuit in response to the amplitude of the output voltage of the a.c. power supply, a zero-cross timing detecting circuit for detecting the time of the zero-crossing of the output voltage of the a.c. power supply, a sawtooth wave generating circuit for generating a sawtooth wave having a ramp corresponding to a voltage adjusted by the voltage adjusting circuit in response to the zero crossing detected by the zero-cross timing detecting circuit, and a switching timing control circuit for controlling the conduction time of said switching element in response to the ramp of the sawtooth wave generated by the sawtooth wave generating circuit.

2. An apparatus as defined in claim 1 wherein the conduction timing control circuit is operates to make the conduction timing phase angle of the switching element 180° when the output of the demodulation circuit is zero.

3. An apparatus as defined in claim 1 wherein the switching element comprises a triac.

4. An apparatus as defined in claim 1 wherein the lamp comprises a halogen lamp utilized in an electrophotographic copying machine.

5. An apparatus as defined in claim 1 wherein the light-emitting element and the photodetector comprises a photocoupler including a light-emitting diode and a phototransistor.

* * * * *